United States Patent [19]

Weber

[11] Patent Number: 4,888,840

[45] Date of Patent: Dec. 26, 1989

[54] METHOD FOR MERCERIZING TEXTILE FABRIC WEBS AND APPARATUS FOR CARRYING OUT THE METHOD

[75] Inventor: Hans Weber, Uzwil, Switzerland

[73] Assignee: Benninger AG, Uzwil, Switzerland

[21] Appl. No.: 323,200

[22] Filed: Mar. 13, 1989

Related U.S. Application Data

[63] Continuation of Ser. No. 841,659, Mar. 20, 1986, abandoned.

[30] Foreign Application Priority Data

Mar. 21, 1985 [CH] Switzerland ..... 1250/85

[51] Int. Cl.[4] ..... D06B 3/12; D06B 7/08

[52] U.S. Cl. ..... 8/151; 68/9; 68/13 R; 68/205 R; 26/89

[58] Field of Search ..... 26/89; 68/205 R, 62, 68/22 R, 9, 13 R; 8/150, 151, 151.1, 158

[56] References Cited

U.S. PATENT DOCUMENTS

| | | | |
|---|---|---|---|
| 737,374 | 8/1903 | Ecob | 68/9 |
| 821,812 | 5/1906 | Mather et al. | 68/9 |
| 975,074 | 11/1910 | Robson | 68/9 |
| 1,577,393 | 3/1926 | Voegeli | 68/13 R X |
| 1,875,984 | 9/1932 | Bosshard | 68/9 |
| 2,239,636 | 4/1941 | Weiss | 68/9 X |
| 2,597,572 | 5/1952 | Dayan | 68/9 X |
| 2,769,685 | 11/1956 | Cowles et al. | 68/9 X |
| 4,376,632 | 3/1983 | Coderasa | 68/9 X |

*Primary Examiner*—Frankie L. Stinson

*Attorney, Agent, or Firm*—William R. Hinds

[57] ABSTRACT

After leaving the hot lye bath (2) the fabric web (1) is immediately cooled down in a cooling zone (C) and only then passed to a residence zone (5) in which the lye acts on the fabric. Stretcing of the fabric web is then effected in a widthwise stretching zone (E), wherein it is again heated, preferably by a feed of hot weak lye. That combination of method steps provides optimum mercerizing effects with careful removal of shrinkage of the fabric.

5 Claims, 1 Drawing Sheet

Figures 1, 2:
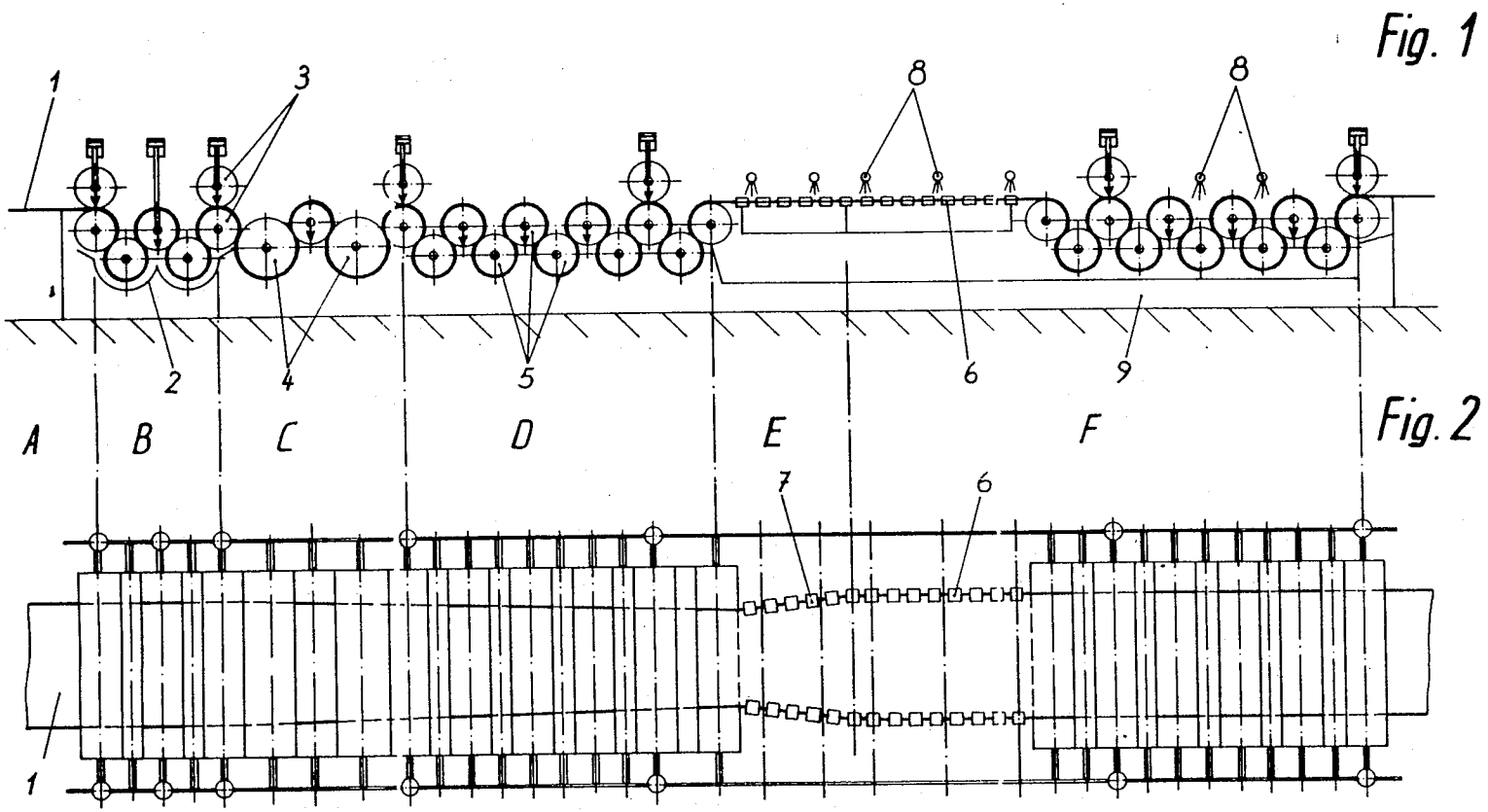

A
B
C
D
E
F
1
2
3
4
5
6
7
8
9

METHOD FOR MERCERIZING TEXTILE FABRIC WEBS AND APPARATUS FOR CARRYING OUT THE METHOD

This is a continuation of application Ser. No. 841,659 filed Mar. 20, 1986, and now abandoned.

This invention relates to a method of hot-mercerizing textile fabric webs wherein the web firstly passes through an impregnation zone with a hot lye bath and then a cooling zone, and wherein after the impregnation step shrinkage of the web is eliminated with a stretching mechanism, and to apparatus for hot-mercerizing textile fabric webs with a hot lye bath for the impregnation operation, a cooling zone and a stretching mechanism for eliminating shrinkage after the impregnation step. A very wide range of alternative forms of mercerising methods have already long been known. Such methods are used to try to produce various effects on flat textile articles, such as for example an increase in lustre, enhanced affinity for dyes and in particular dimensional stability. Modern mercerising machines are intended to produce the desired effects at a minimum level of apparatus expenditure and with the shortest through-put times, for considerations relating to operational economy.

DD-A-No. 59 766 discloses a mercerising method in which the flat textile article is dipped into a hot lye bath after a preliminary heat treatment during a relatively short residence time on cylindrical rolls with a fixed or bound path for the article. The lye then acts on the fabric during a residence time during which the fabric is guided without bath contact over cylindrical rolls. That is then followed by a cooling operation and widthwise stretching.

DE-A-No. 24 05 006 discloses a similar method in which the textile material is also only briefly dipped into a hot lye bath. However after the hot lye bath the textile material is passed through a residence zone in which it is again acted upon by lye. In addition the material support in the residence section is not continuously bound together but is interrupted. It is only after passing through the residence zone that the textile material is cooled and then stretched.

U.S. Pat. No. 1,577,393 discloses a mercerising method in which the fabric web is passed from a hot lye bath at about 100° C. in an unbound or unrestrained path to a cooling zone where it is cooled to about 5° to 10° C. After leaving the cooling zone, the fabric web, also in an unrestrained path, passes through a hot water tank and then various cold water tanks in which the web is washed out. Widthwise stretching of the web is effected at pairs of widthwise stretching rollers which are arranged after the hot water tank at the locations of transition to the individual cold water tanks. The unbound or unrestricted path of movement has the result that the web of fabric varies very greatly in regard to its width, which then has to be restored again in the widthwise stretching zone. In addition after the heating operation or after the widthwise stretching operation, that method does not involve any real stabilizing step but a washing-out process with the web being unbound or unrestrained, in which case the fabric can again shrink in regard to width.

A problem with known hot mercerising methods is that the cooling operation requires a prolonged residence time and/or lower cooling temperatures. Therefore, in known methods of the general kind set forth in the opening part of this specification, the cooling operation was effected directly prior to the stretching operation. In that case problems occurred in regard to the widthwise stretching operation carried out on the fabric which had already cooled down. The result of that was damage to the fabric such as for example tears at the edge. In addition a part of the mercerising effect occurs precisely in the cooling step so that the relatively late step of cooling the fabric down directly prior to the stretching mechanism also presents disadvantages.

The object of the present invention is to provide a method and an apparatus of the kind set forth in the opening part of this specification, which make it possible to achieve optimum mercerising effects while stretching the web widthwise in a careful fashion, by reducing the shrinkage forces prior to the widthwise stretching operation.

In regard to the method, that object is obtained by a method of hot-mercerizing a textile fabric web comprising passing the web through an impregnation zone to impregnate the web in a hot lye bath, passing the impregnated web from the hot lie bath through a positive cooling zone where it is positively cooled to less than about 25° C., passing the cooled web from the cooling zone through a residence zone, passing the web from the residence zone through a stretching zone having a stretching mechanism in the form of a tensioning frame having an intake area of conical sections such that the web is subjected to a controlled and continuous stretching, after the residence zone, and no later than the tensioning frame, reheating the web by the application of hot weak lye to reduce shrinkage forces in the web, and guiding the web from the hot lye bath through the cooling zone and the residence zone to the tensioning frame on cylindrical rolls forming a continuously constrained web path to avoid uncontrolled and excessive shrinkage. In regard to the apparatus, that object is achieved by providing apparatus for hot-mercerizing a textile fabric web comprising means for passing the web through an impregnation zone to impregnate the web in a hot lye bath, means for passing the impregnated web from the hot lye bath through a positive cooling zone where it is positively cooled to less than about 25° C., means for passing the cooled web from the cooling zone through a residence zone, means for passing the web from the residence zone through a stretching zone having a stretching mechanism in the form of a tensioning frame having an intake area of conical section such that the web is subjected to a controlled and continuous stretching, means for reheating the web by the application of hot weak lye after the residence zone and no later than than tensioning frame to reduce shrinkage forces in the web, and wherein the means for passing the impregnated web from the hot lye bath through the positive cooling zone and the residence zone to the stretching zone includes means guiding the web from the hot lye bath through the cooling zone and the residence zone to the tensioning frame on cylindrical rolls forming a continuously constrained web path to avoid uncontrolled and excessive shrinkage.

By virtue of the web of fabric being immediately cooled and transported in a bound or restrained fashion after the hot lye bath, it was surprisingly found, in spite of overcoming relatively substantial temperature differences, that the mercerising effects can be substantially enhanced. The fabric is already cooled while it is passing through the residence zone so that the residence zone produces the optimum action in regard to the mercerising effects. By virtue of the fabric web being guided from the hot lye bath to the stretching mechanism on cylindrical rolls in a constrained path, the method avoids uncontrolled and excessive shrinkage. Guiding the web over cooling rolls after the impregnation operation permits immediate swelling of the article. That method permits a substantially simplified apparatus structure and increases the degree of flexibility for use of various lye concentrations and lye temperatures, in comparison with known methods. By virtue of subsequent reheating of the fabric web when it has already cooled down, the shrinkage forces of the swollen cotton fibres can be substantially reduced. That not only permits the fabric web to be stretched in a careful fashion, but it also provides for greater gains in width. The combination of those method steps which are not obvious per se, namely the step of immediately cooling down the web after the hot lye bath and the subsequent step of reheating the cooled web provide both an intensive mercerising action with optimum effects and also careful stretching of the fabric web.

It has been found particularly advantageous for the web to be cooled down to 25° C. or less in the cooling zone.

The operation of reheating the fabric web is effected in a particulaly advantageous manner by the application of hot weak lye, the effect of which can be further optimized by its being applied in the conical intake area of a tensioning frame for stretching the fabric web.

An embodiment of the invention is described in greater detail hereinafter and illustrated in the drawing in which:

FIG. 1 is a side view in highly simplified form of a mercerising apparatus according to the invention, and FIG. 2 is a plan view of the apparatus shown in FIG. 1.

A fabric web 1 is introduced into the apparatus in the introduction zone A. In certain situations of use, preheating of the fabric web is already possible, for example by way of heated rolls or by radiant heat. Arranged in the impregnation zone B is a hot lye bath 2 through which the fabric web passes in a bound or constrained path. The impregnation operation is carried out for example by means of soda lye or another lye which is suitable for the mercerising effect. The temperature of the lye in the hot lye bath may be from 30° to 110° C., and the conventional lye temperature should also be taken into consideration. A level of lye concentration of between 20° and 32° Bé is sought. Operation is predominantly effected at 20° or 30° Bé.

The impregnation time is only a few seconds, for example from 2 to 5 seconds. The web length in the impregnation zone B is about 3 to 4 meters. By virtue of that reduction in the impregnation zone to practically Foulard conditions, the impregnation operation requires only small amounts of lye which are relatively easy to handle. The hot lye is utilized for more rapid impregnation without fibre swelling.

After passing through a pair of squeeze rolls 3, the fabric web 1 passes from the hot lye bath into the cooling zone C where it is cooled down to less than 25° C., preferably to about 20° C., by means of cooling rolls 4. The web length in the cooling zone C is about 3 to 3.5 meters and the residence time is about 2 to 5 seconds.

After leaving the cooling zone C the fabric web passes into the residence zone D which substantially comprises direction-changing rolls 5 in directly juxtaposed relationship. In the residence zone, the fabric web is guided without bath or float contact in a bound or constrained path. The web length in the residence section is about 9 to 10 meters. As can be seen in particular from FIG. 2, permanent shrinkage of the fabric web is effected in the cooling zone C and in the residence zone D.

After the residence zone D, the fabric web 1 is passed to the widthwise stretching zone E. The tensioning apparatus used is a tensioning frame 6 with quotient regulation, with which the desired dimension in respect of length and width can be preselected and maintained. Arranged above the frame 6 are spray nozzles 8 from which a hot medium such as for example hot weak lye can be sprayed onto the fabric web. In particular in the conical or tapering intake area 7, the application of hot weak lye produces a substantial and careful reduction in the shrinkage forces in the fabric web.

After the stretching zone E, the fabric web passes into a stabilization and lye-removal zone F. The zone F already begins on the tensioning frame 6 where weak lye is also applied by way of the spray nozzles 8 after the intake area 7. Adjoining the tensioning frame 6 is a stabilizing division 9 in which the fabric web is guided in per se known manner on cylindrical rolls in a bound or constrained path through various chambers. Weak lye is also applied by way of the nozzles 8 in the stabilizing division 9. In regard to the tensioning frame 6 and in the stabilizing division 9, the aim is a counter-flow principle wherein lye of low concentration is applied to the fabric web portions which are the most rearwardly trailing portions in the direction of movement through the equipment. The level of concentration of the lye thus increases in the opposite direction to the direction of movement of the web. It will be appreciated that other stretching mechanisms may also be used instead of the tensioning frame 6. However the use of the tensioning frame instead of a Mycock stretching mechanism gives a uniform warp thread number at the edge and in the middle of the fabric web.

After leaving the stabilizing section, the fabric web 1 is passed to a washing machine (not shown) in which a step of washing out any residues of lye still contained in the fabric is effected in per se known manner.

I claim:

1. A method of hot-mercerizing a textile fabric web comprising passing the web through an impregnation zone to impregnate the web in a hot lye bath, passing the impregnated web from the hot lye bath through a positive cooling zone where it is positively cooled to less than about 25° C., passing the cooled web from the cooling zone through a residence zone, passing the web from the residence zone through a stretching zone having a stretching mechanism in the form of a tensioning frame having an intake area of conical section such that the web is subjected to a controlled and continuous stretching, after said residence zone, and no later than said tensioning frame, reheating the web by the application of hot weak lye to reduce shrinkage forces in the web, and guiding the web from the hot lye bath through the cooling zone and the residence zone to the tensioning frame on cylindrical rolls forming a continuously constrained web path to avoid uncontrolled and excessive shrinkage.

2. A method according to claim 1 further comprising, after the tensioning frame, passing the web through a stabilizing division on cylindrical rolls forming a continuously constrained web path.

3. Apparatus for hot-mercerizing a textile fabric web comprising means for passing the web through an impregnation zone to impregnate the web in a hot lye bath, means for passing the impregnated web from the hot lye bath through a positive cooling zone where it is positively cooled to less than about 25° C., means for passing the cooled web from the cooling zone through a residence zone, means for passing the web from the residence zone through a stretching zone having a stretching mechanism in the form of a tensioning frame having an intake area of conical section such that the web is subjected to a controlled and continuous stretching, means for reheating the web by the application of hot weak lye after said residence zone and no later than said tensioning frame to reduce shrinkage forces in the web, and wherein said means for passing the impregnated web from the hot lye bath through the positive cooling zone and the residence zone to the stretching zone includes means guiding the web from the hot lye bath through the cooling zone and the residence zone to the tensioning frame on cylindrical rolls forming a continuously constrained web path to avoid uncontrolled and excessive shrinkage.

4. Apparatus as claimed in claim 3 further comprising means for passing the fabric web through a stabilizing division after the tensioning frame in a continuously constrained web path on cylindrical rolls.

5. Apparatus according to claim 3 wherein said means for reheating the web by the application of hot weak lye comprises spray nozzles arranged above the conical intake area of the tensioning frame for spraying hot weak lye onto the fabric web.

* * * * *